United States Patent [19]

Katakami

[11] Patent Number: 4,788,472

[45] Date of Patent: Nov. 29, 1988

[54] FLUOROESCENT DISPLAY PANEL HAVING INDIRECTLY-HEATED CATHODE

[75] Inventor: Kanji Katakami, Tokyo, Japan

[73] Assignee: NEC Corporation, Japan

[21] Appl. No.: 809,052

[22] Filed: Dec. 13, 1985

[30] Foreign Application Priority Data

Dec. 13, 1984 [JP] Japan ..... 59-263421

[51] Int. Cl.[4] ..... H01J 1/24; H01J 61/06

[52] U.S. Cl. ..... 313/496; 313/491; 313/340

[58] Field of Search ..... 313/491, 495, 496, 513, 313/518, 519, 337, 340, 346 R, 346 DC

[56] References Cited

U.S. PATENT DOCUMENTS 4,100,449 7/1978 Gange ..... 313/340 X 4,123,687 10/1978 Poirier et al. ..... 313/491 X 4,468,589 8/1984 Hikida ..... 313/496

*Primary Examiner*—David K. Moore

*Assistant Examiner*—K. Wieder

*Attorney, Agent, or Firm*—Laff, Whitesel, Conte & Saret

[57] ABSTRACT

A fluoroescent display panel has at least one indirectly heated cathode which is easy to manufacture, at a low cost. The cathode produces a uniformly lit display across the entire read out. An indirectly heated cathode comprises a metal sleeve having a layer of electron emissive material. A heating wire passes through the metal sleeve. The metal sleeve and the heating wire are electrically isolated from each other by an insulative layer on the heating wire, except at one portion where the metal sleeve and the heating wire are mechanically and electrically connected to each other.

15 Claims, 2 Drawing Sheets

FLUOROESCENT DISPLAY PANEL HAVING INDIRECTLY-HEATED CATHODE

BACKGROUND OF THE INVENTION

This invention relates to a fluorescent display panel having an indirectly heated cathode, and more particulary, to the structure of the indirectly heated cathode.

One prior art fluorescent display panel uses an insulated substrate with displays and anodes mounted thereon. This structure is sealed in a vacuum glass envelope. The display is viewed through the envelope.

In contrast, another fluorescent display panel is disclosed in U.S. Pat. No. 4,455,774. An insulative substrate is made transparent, and an anode segment group is disposed on the insulating substrate. The segment group is made of a transparent material or is formed with a mesh structure. A fluorescent material is coated on the anode segment. The fluorescent display is observed through a surface of the substrate which is opposite to the surface on which the anode segment is formed.

In both of these types of fluorescent display panels, the cathode wire is stretched in common across all of the indicating patterns. Accordingly, a different potential distribution is created, with respect to the voltage of an operating circuit, within the voltage applied to the cathode wire. This potential distribution appears between the cathode wire and each of the anode segments constituting the display pattern. As a result, when the cathode wire is heated and actuated by a DC power source, a fluorescent display panel is partially illuminated, in different degrees of brightness. Particularly, when there is a multi-digit display panel having a long cathode wire to which a higher heating voltage is applied, the display patterns are illuminated in different brightness which vary one pattern after another.

SUMMARY OF THE INVENTION

An object of this invention is to provide an improved fluorescent display panel having at least one indirectly heated cathode which is easy to manufacture, at a low cost.

Another object of this invention is to provide a fluorescent display panel with a long lifetime and with a uniform brightness.

According to this invention, an indirectly heated cathode comprises a metal sleeve which is coated with a layer of electron emissive material. A heating wire passes through the metal sleeve. The metal sleeve and the heating wire are electrically isolated from each other by an insulative layer coated on the heating wire, except at one portion where the metal sleeve and the heating wire are electrically connected to each other.

DESCRIPTION OF THE PREFERRED EMBODIMENTS

Figure 1:
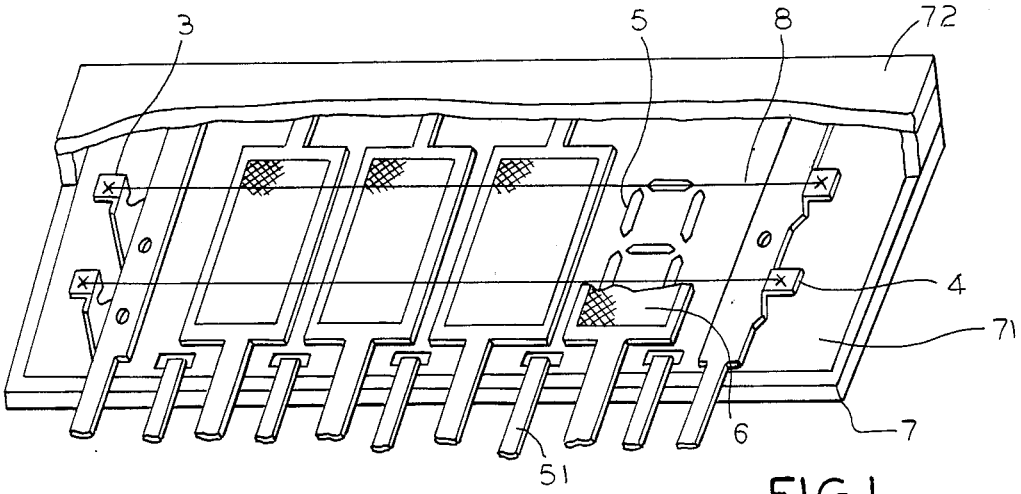
FIG. 1 (PRIOR ART)
FIG. 1 is a partially cutaway, perspective view of a prior art fluorescent display panel.
Figure 2:
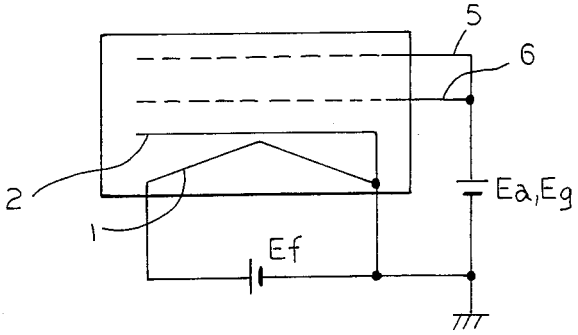
FIG. 2 (PRIOR ART)
FIG. 2 is an equivalent circuit diagram of a prior art driving circuit employing an indirectly heated cathode wire.

In one type of prior art fluorescent display panels, as shown in FIG. 2, an insulative substrate 7 is coated with an insulative layer 71, which surrounds display segments 5. The display segments 5 comprises anode segments and a fluorescent material coated on the anode segments. The anode segments are connected to the external anode leads 51 by means of an internal circuit pattern (not shown). Grid electrodes 6 are disposed at positions which are above the anode segments, with a proper spacing therebetween. Cathode wires 8 are disposed at a proper spacing from the grid electrodes. The ends of the cathode wires are welded on the supporting members 3 and 4. A glass cover 72 is then sealed to the substrate 7 to form a sealed vacuum container. In this fluorescent display panel, the display pattern is observed through the glass cover 72.

In the publication disclosure No. SHO-58-193549 for a Japanese Utility Model Application, an indirectly heated cathode wire is used instead of an ordinary, directly heated cathode wire. More particularly, as shown in FIG. 2, when the cathode electrode 2 and the heating wire 1 are commonly connected to the negative side of the filament voltage source $E_f$, a potential difference appears between cathode 2 and anode 5, or grid 6, and that difference becomes uniform along the length of the cathode wire. Anode 5 and grid 6 are connected to the voltage source Ea and Eg.

A specific structure of this indirectly heated cathode wire comprises a heating wire, an insulative layer coated on the surface of the heating wire, a metal layer coated on the surface of the insulative layer, by means of a thin film forming technique. An electron emissive material layer is coated on the surface of the metal layer. The electrical connection between the metal layer and the negative side of the voltage source is achieved by connecting an additional electrode terminal.

However, since the heating wire is very thin, it is extremely difficult to form the metal layer around the insulative layer, with a uniform thickness. So far, such a structure has not been reduced into practical use due to the requirement of a huge and expensive thin film forming device. Therefore, there are no mass production facilities for this structure. Furthermore, the thin metal layer is fragile if it is subjected to an external force formed on the insulative layer by a thin film forming technique. Thus, it is difficult to connect the metal layer to the additional electrode terminal. As a result, this structure has a poor reliability. When the thickness of the metal layer is not uniform, cracks could be caused in the metal layer due to the ON-OFF heat cycle of the heating wire. The result is a short lifetime for the display panel.

Figure 3:
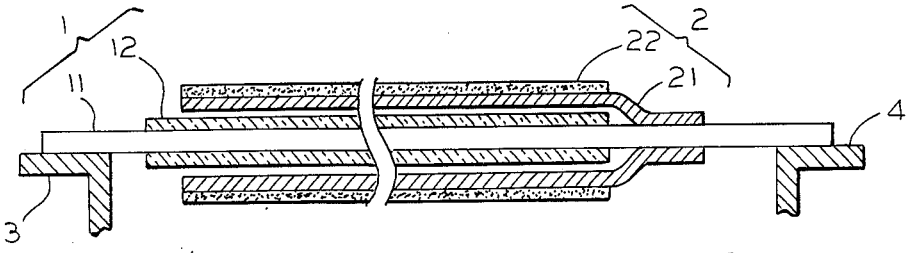
FIG. 3 is a longitudinal cross sectional view of an indirectly heated cathode, according to a first embodiment of the invention.

In FIG. 3, an indirectly heated cathode comprises a filament 1 passing through a cathode sleeve 2. The filament 1 includes a heating wire 11 coated with an insulative layer 12 to completely avoid contact between the heating wire 11 and the cathode sleeve 2. The cathode sleeve 2 includes a metal sleeve 21 coated with a layer 22 of electron emissive material. One end of the metal sleeve 21 is crimped to the heating wire 11 to achieve an electrical contact therebetween. At both ends of the filament 1, the insulative layer 12 is removed to weld the heating wire 11 to the support members 3 and 4.

A typical example of the indirectly heated cathode according to the above embodiments, is as follows:

The heating wire 11 is a tungsten wire having a diameter of 0.1 mm. The insulative layer 12 is aluminum oxide which is about 50 μm thick and which is formed by electrically depositing powder of aluminum oxide around the tungsten wire 11 and then sintering it at 1650° C. As for the metal sleeve 21, a nickel tube having an inner diameter of 0.25 mm and an outer diameter of 0.35 mm is used. A compound layer of barium oxide, calcium oxide and, or strontium oxide is deposited on the nickel tube in the thickness of about 15 μm.

Figure 4:
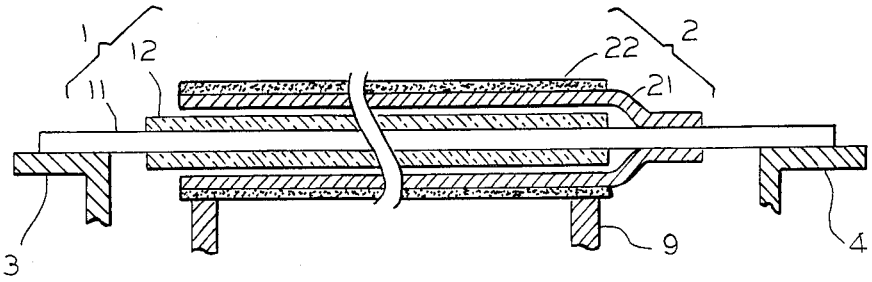
FIG. 4 is a longitudinal cross sectional view of an indirectly heated cathode, according to a second embodiment of the invention.

In the first embodiment, although an indirectly heated cathode is supported by a pair of support members at the ends of the heating wire 11, additional support members 9 may be used to support the cathode sleeve 2, as shown in FIG. 4. The additional support members 9 are effective to maintain a distance between the cathode and grid. The number and position of the additional support members is not limited to the embodiment of FIG. 4. When the electric potential of the support members is different from the potential of the cathode sleeve, the cathode sleeve should be supported via insulative material, such as mica. Even in such a structure, the effect of eliminating the differences of brightness can be achieved.

In the foregoing embodiments, the crimped portion of the metal sleeve is positioned at the place where the insulative layer 12 is not coated on the heating wire 11. However, it is not necessary to remove the insulative layer 12 from the heating wire 11 at the crimped portion.

Figure 5:
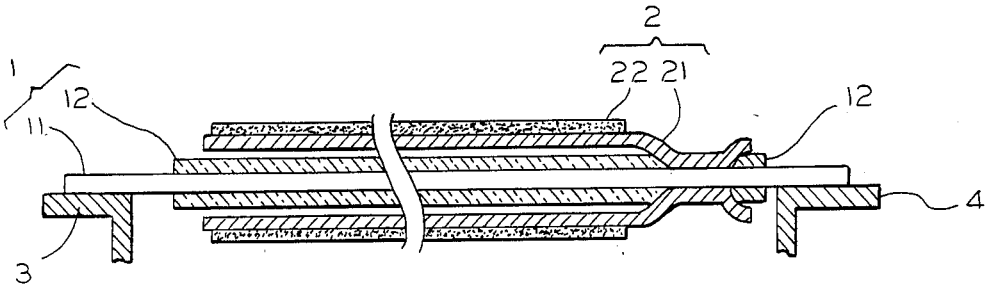
FIG. 5 is a longitudinal cross sectional view of an indirectly heated cathode, according to a third embodiment of the invention.

In the embodiment of FIG. 5, one end of the metal sleeve 21 is crimped onto the insulative layer 12. The electrical contact can be achieved by breaking the insulative layer 12 due to the crimping pressure. To achieve a high reliability of electrical contact between the metal sleeve 21 and the heating wire 11, additional contact means can be used as shown in FIG. 6.

Figure 6A:
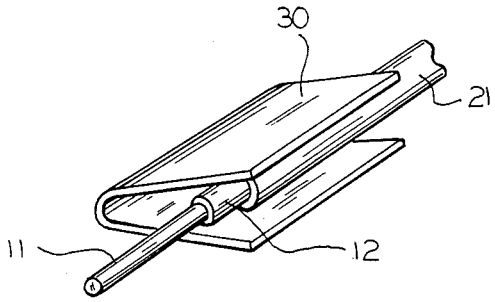
FIGS. 6A and 6B are perspective views of a portion of an electrical connection between a metal sleeve and a heating wire, according to a fourth embodiment of the invention.
Figure 6B:
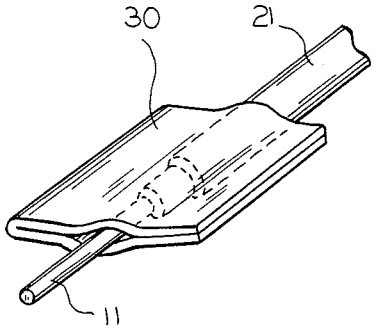

FIG. 6A shows a metal chip or plate 30 folded over a contact portion of the metal sleeve 21 and the heating wire 11. When the metal chip or plate 30 is crimped as shown in FIG. 6B, the metal sleeve 21 can be electrically connected to the heating wire 11 regardless of the condition of the insulative layer 12.

The embodiments shown in FIG. 5 and FIG. 6 are superior to that shown in FIG. 3 in view of the ease of the manufacturing process due to an elimination of the process for removing the insultive layer 12 located inside the metal sleeve 21.

The metal sleeve 21 can be formed as a seamless tube by a repeated pulling process, after processing a metal plate. However, such a seamless metal sleeve makes it difficult to pass the filament therethrough. To this end, it is preferable to surround the filament with thin film metal tape, such that a joint line is formed along the length of the filament line. This line is formed by pulling a belt-like metal foil together with the filament 1 through the hole of a pulling device. Using this technique, any desired length of indirectly heated cathode may be easily obtained, with a low cost. Ideally, the joint seam has no gap. The inside surface of the metal sleeve is in close contact with the insulative layer 12. However, the close contact therebetween is hard to attain due to the difficulty of the pulling process, by using the pulling device.

To faciliate the pulling process, it is preferable to make a small gap between the metal sleeve 21 and the filament 1 by making the inside diameter of the metal sleeve slightly larger than the outer diameter of the wire. However, from a practical point of view, it is very difficult to avoid a partial overlapping of the side edges of the metal foil as long as the gap of the joint seam is made zero. Moreover, the cross section of the metal sleeve 21 tends to change along the length of the filament.

These factors tend to cause a deterioration of the uniformness of the electron emission distribution along the filament.

To avoid such shortcomings, it is preferable to make the width of the metal foil equal to or less than the outer circumference of the insulative layer 12, so as to form a slight gap extending in the direction of the filament extension when the metal foil surrounds the filament 1, with a small gap therebetween.

Figure 7:
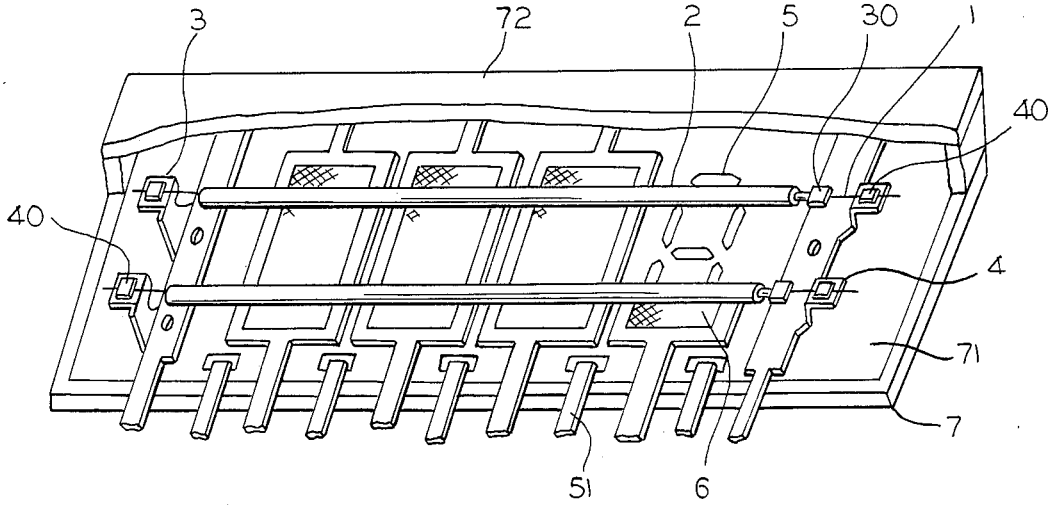
FIG. 7 is a partially cutaway, perspective view of a fluorescent display panel employing the indirectly heated cathodes of the invention.

Referring to FIG. 7, a pair of indirectly heated cathodes, of the type shown in FIG. 6, are employed for a multi-digit fluorescent display panel. Both ends of the heating wire are respectively coupled to welding tabs 40, such as Ni foil, to faciliate the welding process at the support members 3 and 4. The metal chip 30 is used for connecting the metal sleeve 21. The heating wire 11 can be provided by using a conventional process of providing the welding tabs 40. A desirable indirectly heated cathode can be provided without causing a special difficulty.

Since the indirectly heated cathode has a larger diameter compared with a conventional directly heated cathode, this invention is suitably applied to the cathodes of a rear view type fluorescent display panel, as disclosed in U.S. Pat. No. 4,455,774. In FIG. 7, for example, a display pattern can be observed through transparent substrate 7, via a transparent or mesh anode electrode, thus the size of the cathodes does not relate to the observation quality.

According to the present invention, as described in the foregoing specification, a metal foil sleeve is provided around the filament, instead of being directly deposited as a thin metal film around the filament. The reliability of an electrical contact between the metal sleeve and the heating wire is improved and the lifetime of the cathode is increased.

Those who are skilled in the art will readily perceive how to modify the invention. Therefore, the appended claims are to be construed to cover all equivalent structures which fall within the true scope and spirit of the invention.

What is claimed is:

1. A fluorescent display panel having an indirectly heated cathode, siad cathode comprising a heating wire, an insulative layer coated on the surface of said heating wire, a metal sleeve, a portion of the surface of said heating wire being uncoated and exposed from said insulative layer, the insulative layer-coated portion of said heating wire passing through said metal sleeve, and an electron emissive material coated on the outer surface of said metal sleeve, one end of said metal sleeve being mechanically connected to the exposed surface of said heating wire and electrically connected to said heating wire with the remaining portion of said metal sleeve being isolated from said heating wire.

2. The fluorescent display panel as claimed in claim 1, wherein said metal sleeve has a slit extending from one end to another end, along the length of said heating wire.

3. The fluorsecent display panel as claimed in claim 1, wherein said one end of said metal sleeve is connected to said heating wire.

4. The fluorescent display panel as claimed in claim 1, wherein said mechanical connection means is a metal foil crimped onto said metal sleeve and heating wire.

5. A fluorescent display panel comprising an indirectly heated cathode including an elongated heating element, an elongated cathode, substantially all of said elongated cathode except for its end being heated by but separated from said heating element, an electrical insulation between said cathode and said heating element, and an electron emissive material on an outer surface of said cathode, a portion of said element being exposed from said electrical insulation, one end of said cathode being mechanically and electrically connected to the exposed portion of said element with the remaining portion of said cathode being spacially separated from said element.

6. The panel of claim 5 wherein said element and said cathode are coaxial, with said element in the center of said cathode.

7. The panel of claim 6 wherein said cathode is a hollow sleeve fitted over said element and said mechanical connection is a crimped connection.

8. The panel of claim 6 wherein said cathode is a hollow sleeve fitted over said element and said electrical insulation surrounds said heating element within the hollow space of said sleeve.

9. The panel of claim 8 wherein said heating element is supported on its opposite ends and said sleeve is supported by said heating element.

10. The panel of claim 9 and supplemental supports for said sleeve.

11. The panel of claim 5 wherein said electrical insulation is a coating formed on the surface of said heating element, said cathode is an elongated cylindrical tube fitted over said insulation, and said mechanical connection is a plate of metal folded over and crimped to said heating element and to said tube.

12. The panel of claim 5 wherein said heating element is an insulated wire and said cathode is a metal foil wrapped around the insulated wire.

13. A fluorescent display panel having an indirectly heated cathode, said cathode comprising a heating wire, an insulating layer coated on said heating wire except for each of opposite end portions thereof, a metal sleeve around said insulative layer, one end of said metal sleeve extending beyond said insulating layer and being crimped onto said one end portion of said heating wire to achieve a mechanical and electrical connection therebetween and an electron emissive material coated on the outer surface of said metal sleeve.

14. A fluorescent display panel comprising an indirectly heated cathode including a heating wire, an insulating layer coated on said heating wire, a hollow metal sleeve loosely wrapped around said insulative layer, one end of said metal sleeve being crimped onto said heating wire by breaking one end portion of said insulating layer due to the crimping pressure in order to achieve a mechanical and electrical connection between said heating wire and said metal sleeve, and an electron emissive material coated on the outer surface of said metal sleeve.

15. A fluorsecent display panel comprising an indirectly heated cathode including an elongated heating element, an elongated metal tube, substantially all of said elongated metal tube except for its end being heated by but separated from said heating element, an electrical insulation between said metal tube and said heating element, a plate of metal folded over and crimped to said heating element and to one end of said metal tube, said metal tube being mechanically and electrically connected to said heating element by means of said plate of metal, and an electron emissive material coated on the outer surface of said metal tube.

* * * * *